United States Patent [19]

Glück et al.

[11] Patent Number: 4,598,671

[45] Date of Patent: Jul. 8, 1986

[54] VENTILATING SYSTEM ON AN INTERNAL-COMBUSTION ENGINE

[75] Inventors: Roland Glück, Ludwigsburg; Otto Heilemann, Wernau; Günter Bartsch, Schorndorf, all of Fed. Rep. of Germany

[73] Assignee: Daimler-Benz Aktiengesellschaft, Fed. Rep. of Germany

[21] Appl. No.: 735,577

[22] Filed: May 20, 1985

[30] Foreign Application Priority Data

May 24, 1984 [DE] Fed. Rep. of Germany ..... 3419368

[51] Int. Cl.[4] ..... F01P 1/06; F02B 75/06

[52] U.S. Cl. ..... 123/41.31; 123/192 B; 74/604

[58] Field of Search ..... 123/41.31, 41.56, 41.58, 123/41.65, 192 B; 74/603, 604

[56] References Cited

U.S. PATENT DOCUMENTS 4,377,992 3/1983 Zeilinger et al. ..... 123/192 B

FOREIGN PATENT DOCUMENTS 3322769 1/1985 Fed. Rep. of Germany ... 123/192 B 59-29723 2/1984 Japan ..... 123/41.31

*Primary Examiner*—William A. Cuchlinski, Jr.

*Attorney, Agent, or Firm*—Barnes & Thornburg

[57] ABSTRACT

A ventilating system on an internal-combustion engine is described that has balancer shafts for the balancing of mass of the second degree, the balancer shafts are driven by a crankshaft via a toothed belt in a clutch housing into which fresh air is blown via an inlet opening for cooling purposes. For an improved direct cooling of the toothed belt, at least one air guiding duct is connected to the inlet opening. This air guiding duct is formed by ribs and has at least one outlet opening in the direct area of the toothed belt from which air blows out in a targeted manner onto the toothed belt.

12 Claims, 3 Drawing Figures

VENTILATING SYSTEM ON AN INTERNAL-COMBUSTION ENGINE

This invention relates to a ventilating system for an internal combustion engine of the type having balancer shafts for a balancing of mass of the second degree arranged at the engine crankcase. The balancer shafts are in driving connection with the end of the crankshaft located in a clutch housing by means of gear means and a toothed driving belt. An air inlet opening is provided in the clutch housing for accommodating conveying of fresh cooling air.

In DE-PS . . . (Patent Application No. P 33 19 870.5–13), a ventilating system of this type is described where from a bearing housing of the balancer shafts, fresh air is conveyed into the clutch housing in order to keep the temperature in the clutch housing low and thus prevent an impairing of the life of the toothed belt.

The invention is based on the objective of improving the ventilating system on the internal-combustion engine in such a way that the acceptable or admissable temperature for the toothed belt is definitely not exceeded and its durability is increased.

According to the invention, this objective is achieved by providing air guiding duct means connecting to the air inlet opening and having at least one outlet opening in the direct area of the toothed belt for directing fresh air in a targeted manner out onto the toothed belt.

The targeted blowing of fresh air onto the toothed belt reliably holds its temperature below the acceptable value even if the general temperature in the clutch housing should exceed this value. Thus the operational reliability and the durability of the toothed belt are increased.

An especially advantageous embodiment of the invention includes an air guiding duct formed by ribs joined to the clutch housing and extending to the toothed belt. This represents a form of air guiding duct that is especially easy to manufacture.

In further advantageous embodiments of the invention, spoilers are arranged on both sides of the toothed belt and fresh air is conveyed through the space formed by the spoilers. The cooling of the toothed belt is thus improved further since the fresh air is guided past the toothed belt several times.

In further advantageous embodiments of the invention, an air guiding duct is provided which is configured as an air guiding tube that is arranged along the interior side of the toothed belt and has several outlet openings through which fresh air flows out in a targeted manner onto the interior side of the toothed belt. The inside or interior of the toothed belt is preferably cooled. This arrangement is advantageous because of the increased flexing work to which the interior side of the belt is subjected causing it to be in special danger of being overheated.

In certain preferred embodiments, a fan is placed on the crankshaft to facilitate air connegance through the air guiding duct. In other preferred embodiments at least one of the balancers shafts is equipped with a fan-/elements for conveying fresh air. These arrangements represent various possibilities according to the invention that can be carried out at low cost for conveying the fresh air to the toothed belt and through the inside of the crankcase.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
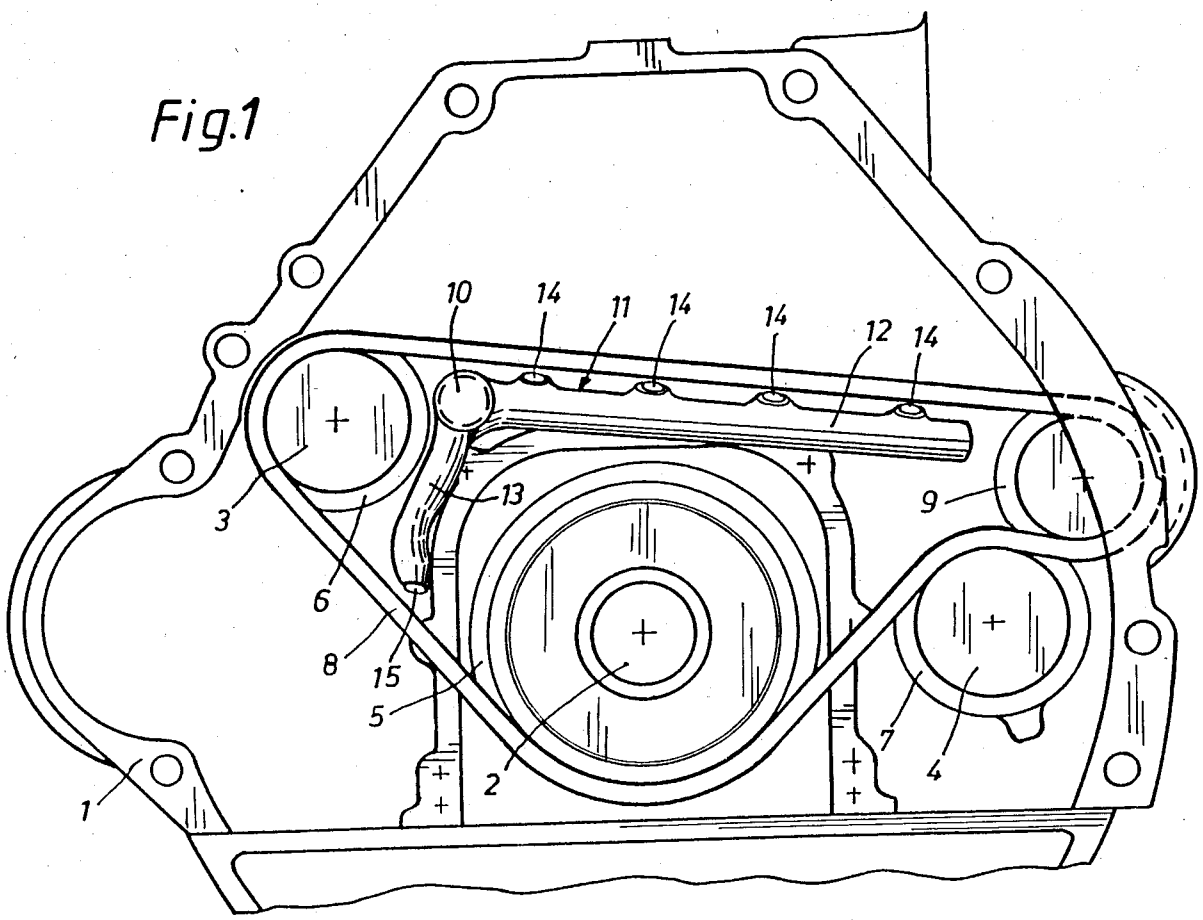
FIG. 1 is a cross-sectional view through a crankcase having an air guiding tube to be used as the air guiding duct, constructed in accordance with a preferred embodiment of the invention.

A crankshaft 2 and two balancer shafts 3, 4 with their longitudinal ends on the driving side, project into a clutch housing 1 connected to a crankcase of an internal-combustion engine. At these longitudinal ends, pulleys, 5, 6 and 7 are placed respectively on the crankshaft 2 and the balancer shafts 3, 4. A toothed belt 8 moving via said pulleys drives the balancer shafts 3, 4 in respective opposite rotational directions. A tension and deflection pulley for the toothed belt 8 has the reference number 9.

For the cooling of the toothed belt 8 according to FIG. 1, fresh air is guided to the inner side of the belt that is especially stressed because of increased flexing work. For this purpose, an inlet opening 10 is arranged in the clutch housing 1 directly adjacent to one balancer shaft 3. Fresh air is guided through said inlet opening 10 into the air guiding tube 11 that is, for example, conveyed by blades fastened on the balancer shaft 3. Said air guiding tube 11 preferably includes two sections 12, 13, of which one section 12 is guided at a narrow distance along the inner side of the segment of the toothed belt 8 located between the balancer shaft 3 and the tension and deflection disk 9, while the other section 13 is guided toward the inner side of the segment of the toothed belt 8 located between the balancer shaft 3 and the crankshaft 2. In section 12 of the air guiding duct 11, several outlet openings 14 are arranged laterally that aim directly at the toothed belt 8. The fresh air coming out of the outlet openings 14 and 15 is thus aimed at the toothed belt 8 in a targeted manner and cools it intensively.

Figure 2:
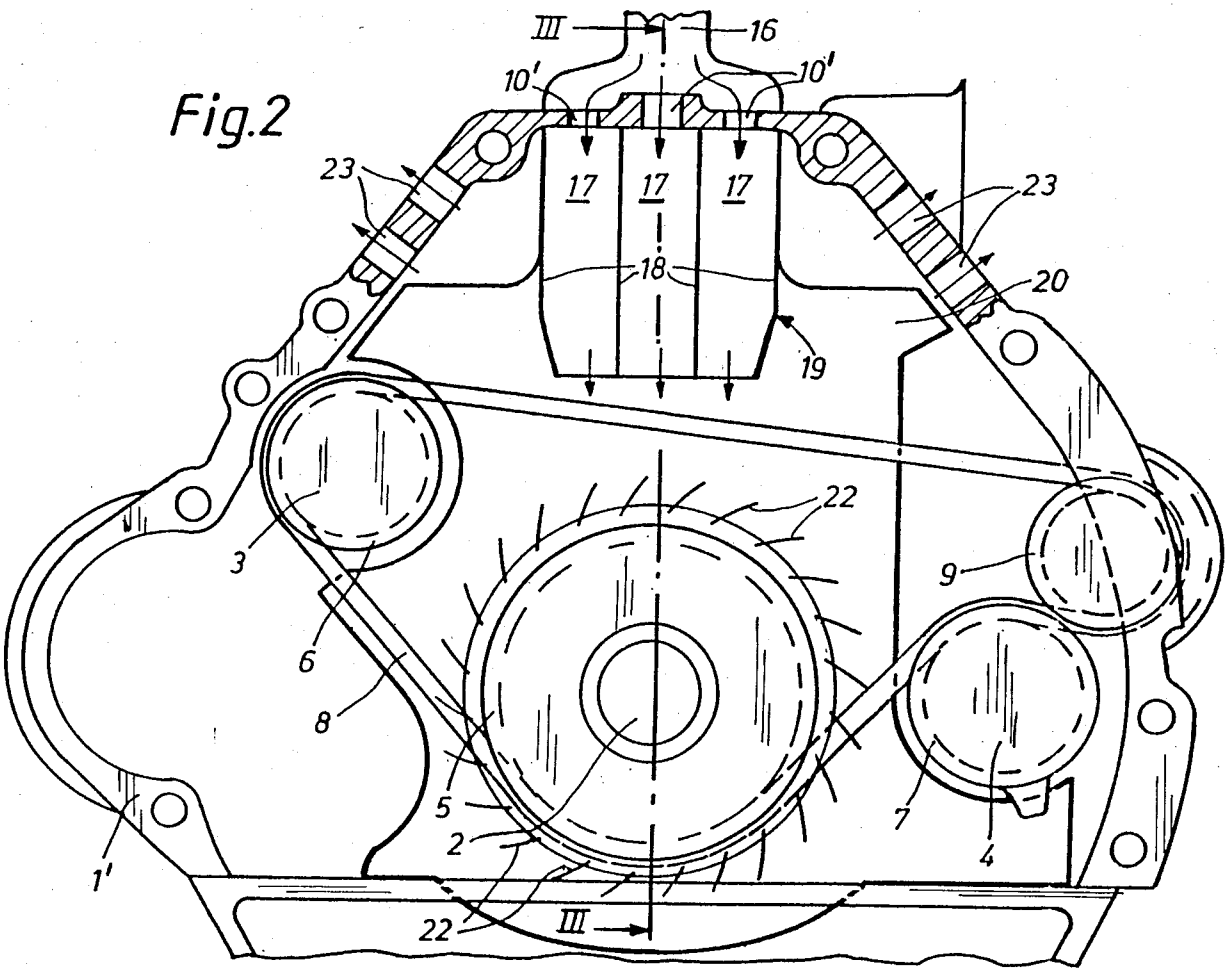
FIG. 2 is a cross-section, similar to that of FIG. 1, illustrating a further preferred embodiment of the invention with an air guiding duct formed by ribs and spoilers.
Figure 3:
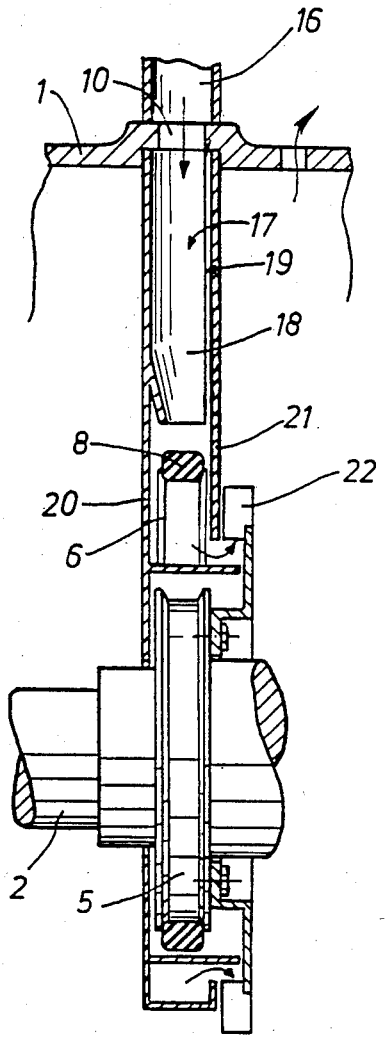
FIG. 3 is a longitudinal section through the embodiment of FIG. 2 taken along line III—III.

In the case of the embodiment shown in FIGS. 2 and 3, an air-intake hood 16 is placed on the clutch housing 1' via the inlet openings 10'. In FIGS. 2 and 3 like reference characters are used for corresponding structure as the FIG. 1 embodiment described above. The air guiding ducts 17 are connected on the interior side, said air guiding ducts 17 being formed by a spoiler 19 fastened directly at the clutch housing 1' and equipped with ribs 18, and by two other spoilers 20 and 21 penetrating most of the clutch housing and enclosing the crankshaft 2. The air guiding ducts 17, in nozzle form, lead in directly above the toothed belt 8 so that said toothed belt is subjected to the fresh air flowing in through the air guiding ducts 17 in a targeted manner and is cooled by it. The conveying of the fresh air, in this case, takes place by means of a fan 22 placed onto the crankshaft 2.

As shown clearly in FIG. 3, the fresh air, after flowing onto the toothed belt 8, between the two spoilers 20 and 21, is guided further through the clutch housing and thus its temperature on the whole is kept down. After a deflection in the area of the fan 22, the fresh air flows in front of the spoiler 21, to outlet openings 23 arranged in the clutch housing 1' and from there to the outside.

Although the present invention has been described and illustrated in detail, it is to be clearly understood that the same is by way of illustration and example only, and is not to be taken by way of limitation. The spirit and scope of the present invention are to be limited only by the terms of the appended claims

What is claimed:

1. A ventilating system on an internal-combustion engine of the type having balancer shafts for a balancing of mass of the second degree are arranged at an engine crankcase with the end of the crankshaft located in a clutch housing, the balancer shafts being in driving connection with the crankshaft by means of a toothed belt, said ventilating system comprising:

an inlet opening for the conveying of fresh air into the clutch housing, and an air guiding duct means connecting to the inlet opening, and having at least one outlet opening in the direct area of the toothed belt for directing fresh air in a targeted manner out onto the toothed belt.

2. A ventilating system according to claim 1, wherein the air guiding duct means is formed by ribs joined to the clutch housing and extending to the toothed belt.

3. A ventilating system according to claim 2, wherein a fan is placed onto the crankshaft which conveys the fresh air through the air guiding duct means.

4. A ventilating system according to claim 2, wherein at least one of the balancer shafts is equipped with elements for the conveying of fresh air.

5. A ventilating system according to claim 1, wherein spoilers are arranged on both sides of the toothed belt, and wherein the fresh air is conveyed through the space formed by said spoilers.

6. A ventilating system according to claim 5, wherein a fan is placed onto the crankshaft which conveys the fresh air through the air guiding duct means.

7. A ventilating system according to claim 5, wherein at least one of the balancer shafts is equipped with elements for the conveying of fresh air.

8. A ventilating system according to claim 1, wherein the air guiding duct means is formed or configured as an air guiding tube that extends along the interior side of the toothed belt and has several outlet openings through which fresh air flows out in a targeted manner onto the interior side of the toothed belt.

9. A ventilating system according to claim 8, wherein a fan is placed onto the crankshaft which conveys the fresh air through the air guiding duct means.

10. A ventilating system according to claim 8, wherein at least one of the balancer shafts is equipped with elements for the conveying of fresh air.

11. A ventilating system according to claim 1, wherein a fan is placed onto the crankshaft which conveys the fresh air through the air guiding duct means.

12. A ventilating system according to claim 1, wherein at least one of the balancer shafts is equipped with elements for the conveying of fresh air.

* * * * *